US007922607B2

(12) United States Patent
Morgan et al.

(10) Patent No.: US 7,922,607 B2
(45) Date of Patent: Apr. 12, 2011

(54) NONCONTACT PRINTING ON SUBSURFACE LAYERS OF TRANSLUCENT COVER GOLF BALLS

(75) Inventors: William E. Morgan, Barrington, RI (US); Kevin M. Harris, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 268 days.

(21) Appl. No.: 12/140,719

(22) Filed: Jun. 17, 2008

(65) Prior Publication Data

US 2008/0248897 A1 Oct. 9, 2008

Related U.S. Application Data

(63) Continuation-in-part of application No. 11/707,493, filed on Feb. 16, 2007, now Pat. No. 7,722,483.

(51) Int. Cl.
*A63B 57/00* (2006.01)

(52) U.S. Cl. ..... 473/409

(58) Field of Classification Search ..... 473/373, 473/374, 409

See application file for complete search history.

(56) References Cited

U.S. PATENT DOCUMENTS

| | | | |
|---|---|---|---|
| 2,809,954 | A | 10/1957 | Kazenas |
| 2,851,424 | A | 9/1958 | Switzer et al. |
| 2,938,873 | A | 5/1960 | Kazenas |
| 3,253,146 | A | 5/1966 | de Vries |
| 3,412,036 | A | 11/1968 | McIntosh |
| D228,394 | S | 9/1973 | Martin et al. |
| 3,989,568 | A | 11/1976 | Isaac |
| 4,123,061 | A | 10/1978 | Dusbiber |
| 4,128,600 | A | 12/1978 | Skinner et al. |
| 4,317,933 | A | 3/1982 | Parker |
| 4,342,793 | A | 8/1982 | Skinner et al. |
| 4,560,168 | A | 12/1985 | Aoyama |
| 4,679,795 | A | 7/1987 | Melvin et al. |
| 4,798,386 | A | 1/1989 | Berard |
| 4,804,189 | A | 2/1989 | Gobush |
| 4,921,759 | A | 5/1990 | Orain et al. |

(Continued)

FOREIGN PATENT DOCUMENTS

| | | |
|---|---|---|
| JP | 2001-087423 | 4/2001 |

OTHER PUBLICATIONS

Mark S. Murphy; "Just Different Enough" Golf World Business; Apr. 8, 2005; p. 2.

(Continued)

*Primary Examiner* — Raeann Trimiew
(74) *Attorney, Agent, or Firm* — Daniel W. Sullivan

(57) ABSTRACT

The present invention relates to a noncontact printing method for applying indicia, such as insignia or stripes, on at least one subsurface layer of a transparent or translucent cover golf ball, e.g. the core, or one or more intermediate layers. The indicia may be visible in ambient light or are only visible when exposed to specific non-ambient light wavelengths, e.g. ultraviolet wavelengths. Advantageously, this method of noncontact printing on subsurface golf ball layers substantially improves the durability of indicia because such indicia are protected from direct abrasion and club impacts by the cover. Moreover, unlike pad printing, noncontact printing forms indicia that are not susceptible to ink degradation because the indicia are solid markings created by very small discrete dots. In one embodiment, both the cover and the intermediate layer (s) may be transparent or translucent and thusly decorated to achieve previously unattainable image depth effects.

9 Claims, 3 Drawing Sheets

U.S. PATENT DOCUMENTS 4,925,193 A 5/1990 Melvin
4,950,696 A 8/1990 Palazotto et al.
4,960,281 A 10/1990 Aoyama
4,985,340 A 1/1991 Palazzotto et al.
4,991,852 A 2/1991 Pattison
4,998,734 A * 3/1991 Meyer ..... 473/356
5,000,458 A 3/1991 Proudfit
5,018,742 A 5/1991 Isaac et al.
5,143,377 A 9/1992 Oka et al.
5,147,900 A 9/1992 Palazzotto et al.
5,156,405 A 10/1992 Kitaoh et al.
5,249,804 A 10/1993 Sanchez
5,256,170 A 10/1993 Harmer et al.
5,326,621 A 7/1994 Palazzotto et al.
5,334,673 A 8/1994 Wu
5,360,462 A 11/1994 Harmer et al.
5,376,428 A 12/1994 Palazzotto et al.
5,427,378 A 6/1995 Murphy
5,442,680 A 8/1995 Schellinger et al.
5,484,870 A 1/1996 Wu
5,494,291 A 2/1996 Kennedy
5,562,552 A 10/1996 Thurman
5,575,477 A 11/1996 Hwang
5,605,761 A 2/1997 Burns et al.
5,672,643 A 9/1997 Burns et al.
5,674,622 A 10/1997 Burns et al.
5,688,191 A 11/1997 Cavallaro et al.
5,692,974 A 12/1997 Wu et al.
5,713,801 A 2/1998 Aoyama
5,783,293 A 7/1998 Lammi
5,800,286 A 9/1998 Kakiuchi et al.
5,803,831 A 9/1998 Sullivan et al.
5,820,488 A 10/1998 Sullivan et al.
5,823,890 A 10/1998 Maruko et al.
5,823,891 A 10/1998 Winskowicz
5,840,788 A 11/1998 Lutz et al.
5,885,172 A 3/1999 Hebert et al.
5,900,439 A 5/1999 Prissok et al.
5,902,191 A 5/1999 Masutani et al.
5,919,100 A 7/1999 Boehm et al.
5,929,189 A 7/1999 Ichikawa et al.
5,938,544 A 8/1999 Winskowicz
5,957,786 A 9/1999 Aoyama
5,957,787 A 9/1999 Hwang
5,965,669 A 10/1999 Cavallaro et al.
5,981,654 A 11/1999 Rajagopalan
5,981,658 A 11/1999 Rajagopalan
5,989,135 A 11/1999 Welch
5,993,968 A 11/1999 Umezawa et al.
6,056,842 A 5/2000 Dalton et al.
6,083,119 A 7/2000 Sullivan et al.
6,120,394 A 9/2000 Kametani
6,149,535 A 11/2000 Bissonnette et al.
6,152,834 A 11/2000 Sullivan
6,179,732 B1 1/2001 Inoue et al.
6,200,232 B1 3/2001 Kasashima et al.
6,207,784 B1 3/2001 Rajagopalan
6,251,991 B1 6/2001 Takesue et al.
6,277,037 B1 8/2001 Winskowicz et al.
6,358,160 B1 3/2002 Winskowicz
6,369,125 B1 4/2002 Nesbitt
6,450,902 B1 9/2002 Hwang
6,462,303 B1 10/2002 Brown
6,548,618 B2 4/2003 Sullivan et al.
6,558,227 B1 5/2003 Kodaira et al.
6,786,569 B2 * 9/2004 Vanhooydonck et al. ..... 347/41
6,790,149 B2 9/2004 Kennedy et al.
6,824,476 B2 11/2004 Sullivan et al.
6,872,154 B2 3/2005 Shannon et al.
6,935,240 B2 8/2005 Gosetti
6,949,595 B2 9/2005 Morgan et al.
7,090,798 B2 8/2006 Hebert et al.
2002/0086743 A1 7/2002 Bulpett
2004/0176184 A1 9/2004 Morgan et al.
2004/0176185 A1 9/2004 Morgan et al.
2004/0176188 A1 9/2004 Morgan et al.
2005/0148409 A1 7/2005 Morgan et al.
2007/0015602 A1 1/2007 Watanabe

OTHER PUBLICATIONS

Wilson Hope golf ball, http://www.pargolf.com/products/Wilson-Hope.htm, Jan. 27, 2005.

Color photographs of Volvik "Crystal" golf ball and packaging, 2005.

Volvik Crystal golf ball, http://www.volvik.co.kr/english/product/crystal.asp, Jan. 21, 2005.

Volvik Golf Ball Brochure, 2005, pp. 1, 16-17 and 24.

Color photographs of Volvik "Crystal" golf ball, 2004.

Color photographs of Wilson "iWound", display model only with clear cover, 2001.

"Urea", Kirk-Othmer Encyclopedia of Chemical Technology. John Wiley & Sons, Inc. copyright 1998.

Color Photographs of Wilson "Quantum" golf ball, late 1990s.

Color Photographs of Pro Keds "Crystal π" golf ball, 1980's.

Pannier Corporation's brochure, "Rubber Printing System".

* cited by examiner

NONCONTACT PRINTING ON SUBSURFACE LAYERS OF TRANSLUCENT COVER GOLF BALLS

CROSS-REFERENCE TO RELATED APPLICATION

This application is a continuation-in-part of U.S. application Ser. No. 11/707,493, filed on Feb. 16, 2007 now U.S. Pat. No. 7,722,483, which is incorporated by reference herein in its entirety.

FIELD OF THE INVENTION

The invention relates to a method of forming indicia on golf balls. In particular, the invention is directed to a method for marking a golf ball using noncontact print technology to create an insignia, stripe, or other type of indicia on one or more internal layers of a translucent cover golf ball.

BACKGROUND OF THE INVENTION

Golf ball covers are routinely marked with various surface indicia, such as the manufacturer's logo and trademark, and the play number, which allows golfers using the same type of golf ball to distinguish one player's ball from that of another. Additional symbols that may also be applied to golf balls include custom figures for promotional purposes as well as specific marks reflecting manufacturing information.

There are different approaches commonly used, mostly water-based or solvent-based printing systems, to add indicia to the dimpled outer surface of a golf ball. One approach involves first creating a decal of the logo or indicia to be printed on the golf ball surface, applying the decal to the spherical, dimpled golf ball surface of the cover, and then spraying the golf ball surface and decal with a clear finish coating. Pad printing is also often used for marking golf ball surfaces, however, very few of the inks employed in pad printing are suitable for use on a golf ball. More specifically, when applied to a golf ball, these inks are not sufficiently durable (impact resistant) to withstand multiple impacts with a golf club. U.S. Pat. No. 6,179,732 discloses a method for applying markings to a golf ball during formation using a two-part mold and a mark-bearing film on the wall of the mold.

During manufacturing of golf balls using conventional printing methods, ink transfer problems are often encountered. For example, in pad printing it is desirable that all of the ink picked up by the printing pad be fully released onto the article to be printed, however, sometimes complete release is not achieved. Consequently, subsequent articles to be printed upon by the same printing pad member can have excessive ink or misaligned ink deposited thereon leading to unwanted ink contamination of balls. Resolution of such problems requires expensive positioning equipment to prevent unwanted contact between balls, between ink depositing members and balls, and between ball handling equipment and balls, respectively.

In addition to the problems associated with ink transfer before the ink is cured or dried, post manufacturing problems are also commonly encountered even after curing takes place. The current water-based inks that work reasonably well for printing on absorbent substrates, such as paper, paperboard, boxboard, and cardboard, do not adhere well to the smooth, nonporous materials typically used in a golf ball. To reduce adherence problems, golf balls generally are subjected to a clear coat covering the golf ball and the printed pattern after an indicia is applied in order to improve appearance as well as to protect the indicia from degradation during the golf ball's normal useful life due to normal play. There are multiple sources of possible degradation to the ball. For example, the ball may be degraded from being struck with a grooved club head or by landing on a rocky or abrasive surface such as a cart path. When adhesion between the protective clear coat and the ink layer of the printed pattern is weak, however, the ink layer can flake, crack, or otherwise degrade more easily under less harsh circumstances. After repeated impacts, such lack of adhesion, toughness, flexibility, and/or hardness yields an unsightly golf ball.

Because a clear coat is typically applied to a golf ball after printing the indicia, custom orders, e.g., imprinting a company logo for a relatively small quantity order, usually requires a special production run that tends to be expensive for the consumer.

Furthermore, water-based coatings, in general, while desirable due to the low toxicity of the solvent, are much harder to evaporate than volatile organic materials, and therefore, are energy intensive, requiring expensive drying ovens to remove the water.

Moreover, coatings and inks used in spraying and pad printing techniques typically involve volatile organic compounds (VOC) found in the compounds used. Manufacturers of printed products may be strongly affected by federal and local regulations that impose restrictions on the emission of VOCs, such as methyl ethyl ketone, acetone, toluene, alcohols, and chlorinated solvents, to the atmosphere.

The prior art describes various methods for the application of indicia to golf balls. For example, U.S. Pat. No. 4,798,386, to Berard, makes reference to white cores and clear covers and even locating decoration on the core to be visible through the clear cover. The Berard concept requires a core which has a satisfactory hue to achieve the desired finished ball coloration. A polybutadiene rubber core of such a color has never been produced and as such, clear cover 2-pc ball have had limited market success.

U.S. Pat. No. 4,998,734 to Meyer, describes a golf ball with a core, a clear cover and "layer interdisposed therebetween." However, the intermediate layer described is a thin layer of paper or plastic material whose purpose is only to bear textural, alphanumeric or graphical indicia. Meyer teaches that the layer should be sufficiently thin to permit substantial transference of impact forces from the cover to the core without substantially reducing the force.

U.S. Pat. No. 6,462,303 to Brown, describes a method for forming indicia on golf ball covers using laser ablation, i.e., directing a beam of laser radiation onto a portion of the cover and irradiating the cover portion wherein the irradiated cover portion is ablated to form a detectable mark. However, this invention does not disclose non-contact printing of subsurface layers.

U.S. Pat. No. 6,935,240 to Gosetti, describes a method for forming indicia on golf ball components, including covers, cores, intermediate layers, and half shells, using a dye sublimation process. However, the invention does not disclose non-contact printing of a golf ball component.

U.S. Pat. No. 6,949,595 to Morgan et al., discloses a multilayer golf ball with a translucent polyurea cover, wherein indicia can be printed on an inner layer such that it is visible through the translucent cover. However, the invention does not disclose non-contact printing of the inner layer.

Although each of the above-identified methods may have a specific application for forming indicia on the surface of a golf ball, none is wholly satisfactory. Accordingly, there is a long-felt need for a golf ball marking procedure that will avoid either the inflexibility, or the complexity and expense, inherent in prior art methods for forming indicia on golf ball surfaces. This long-felt problem has now led the Applicants to develop a desirable method for forming indicia on one or more golf ball layers by means of noncontact printing, which advantageously provides increased indicia durability.

SUMMARY OF THE INVENTION

The invention relates to a method of forming indicia on golf balls. The method comprises the steps of providing a first golf ball subassembly having a first outer surface; utilizing a noncontact printing system to mark the first outer surface with ink that forms a first indicia; forming, around the first golf ball subassembly, a second golf ball subassembly with a second outer surface, wherein the second golf ball subassembly is partially transparent or translucent; and optionally utilizing a printing system to mark the second outer surface with an ink that forms a second indicia. The first subassembly can comprise a core layer, an intermediate layer, or a combination thereof, and the second subassembly can comprise a cover layer.

BRIEF DESCRIPTION OF THE DRAWING

In the accompanying drawing which forms a part of the specification and is to be read in conjunction therewith and in which like reference numerals are used to indicate like parts in the various views.

DETAILED DESCRIPTION OF THE INVENTION

This invention relates to a noncontact printing method for applying indicia, such as insignia, stripes, or other markings, on at least one subsurface layer of a substantially transparent or translucent cover golf ball, e.g. the core, or one or more intermediate layers. The indicia may be visible in ambient light or are only visible when exposed to specific non-ambient light wavelengths, e.g. ultraviolet wavelengths. Advantageously, this method of noncontact printing on subsurface golf ball layers substantially improves the durability of indicia because such indicia are protected from direct abrasion and club impacts by the cover. Moreover, unlike pad printing, noncontact printing forms indicia that are not susceptible to ink degradation because the indicia are solid markings created by very small discrete dots. In alternative embodiments, when a golf ball comprises three or more parts (e.g., a core, intermediate layer(s), and cover), both the cover and the intermediate layer(s) may be substantially transparent or translucent and thusly decorated to achieve previously unattainable image depth effects.

As used herein, "non-contact printing" refers to a form of printing in which an image, such as an indicia, is formed on a substrate without direct contact between the substrate and the apparatus producing the image.

As used herein the terms "indicia" and "marking" are the same for purposes of this invention and are considered to mean symbol, letter, group of letters, design, image, bar code, or the like, that can bee added to a three-dimensional surface such as one or more layers of a golf ball.

As used herein, the term "transparent," in reference to an object, means that the object has an average transmittance of visible light (e.g., between about 380 nm and about 770 nm or alternately between about 400 nm and about 700 nm) of at least about 40%, preferably at least about 60%, more preferably at least about 80%. The average transmittance referred to herein is typically measured for incident light normal (i.e., at approximately 90°) to the plane of the object and can be measured using any known light transmission apparatus and method, e.g., a UV-Vis spectrophotometer. As used herein, the term "translucent" in reference to an object, means that the object has an average transmittance of visible light (e.g., between about 380 nm and about 770 nm or alternately between about 400 nm and about 700 nm) of at least about 10%, preferably at least about 20%, more preferably at least about 30%. Hence, as used herein, the term "translucent" encompasses the term "transparent."

Figure 1:
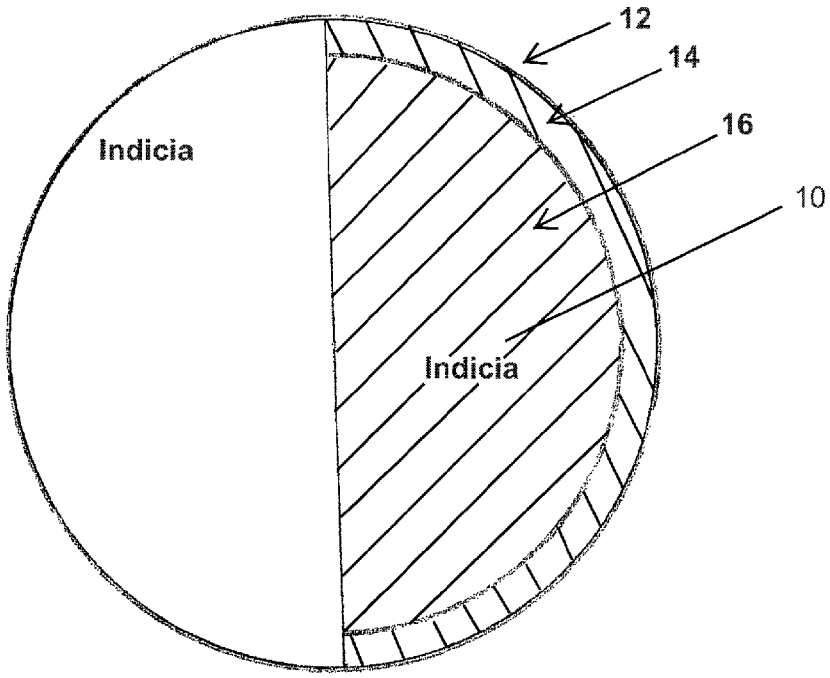
FIG. 1 is a cross-sectional view of a two-piece golf ball according to one aspect of the present invention.
Figure 2:
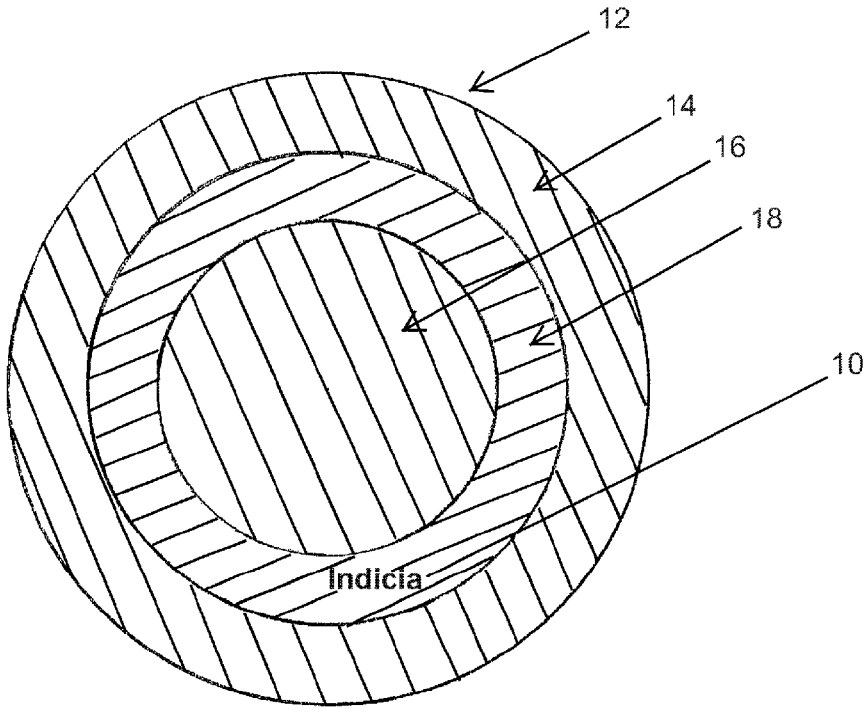
FIG. 2 is a cross-sectional view of a three-piece golf ball according to another aspect of the present invention.
Figure 3:
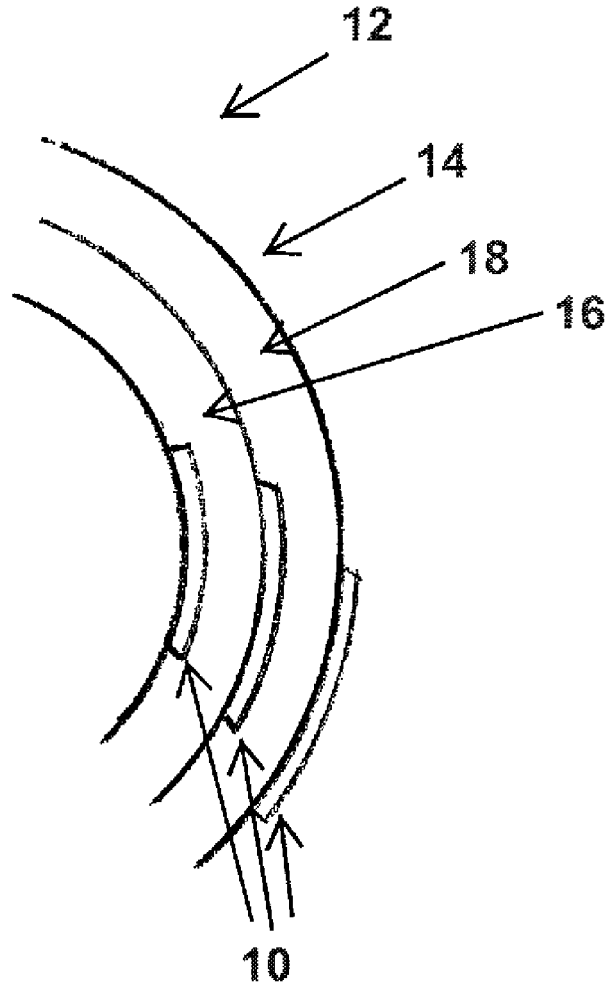
FIG. 3 is a cross-sectional view of a three-piece golf ball according to yet another aspect of the present invention.

As shown in FIGS. 1-3, indicia, or images, 10 are printed on one or more layers of golf ball 12 comprising a translucent cover 14. FIG. 1 shows an embodiment wherein indicia 10 are printed on the core 16 of a two-piece golf ball 12. In one aspect of the invention, cover 14 may be partially translucent and partially opaque as shown in FIG. 1, or it may be a fully translucent cover. The opaque half of cover 14 can optionally have an ordinary surface indicia, which may be formed by conventional means or the inventive noncontact printing method. FIG. 2 shows another embodiment wherein indicia 10 are printed on the intermediate layer 18 of a three-piece golf ball with a fully translucent cover 14. In another variation of the present invention, cover 14 may be half opaque and half translucent.

FIG. 3 shows yet another embodiment wherein golf ball 12 comprises a translucent cover 14 and translucent intermediate layer 18, thus allowing indicia 10 to be printed on any of the cover 14, core 16, or intermediate layer 18, thereby creating image depth effects. As shown, images 10 partially overlap each other with the image on core 16 being the deepest and the image on cover 14 being the top. This creates a visual depth not achievable heretofore. Further, each image 10 can have a different color, such that the overlapped portion of all the images exhibit a combined, mixed color. More particularly, because the transparent or translucent layers may contain dyes, pearlescent pigmentation or other optical enhancements, they can be used to achieve unique overall appearances that add to the aesthetic appeal of the golf ball 12 while simultaneously allowing indicia 10 to remain visible in underlying layers and protecting indicia 10 from abrasion.

In another aspect of the invention, translucent cover 14 and translucent intermediate layer 18 are designed to minimize image distortion. When light passes through a particular medium, its speed is typically reduced, or its path bent, and can cause a distortion of the image observed through the medium. The reduction of speed can be quantified by the index of refraction, which is a value expressed by the ratio $n=c/v$, wherein c is speed of light in a vacuum and v is the speed of light in a given medium. Thus, a relatively low index of refraction n correlates with a relatively high speed of light v in a given medium. In one particular embodiment of the present invention, the indices of refraction of cover 14 and intermediate layer 18 are about 3.0 or less, preferably about 2.0 or less, more preferably about 1.5 or less, most preferably about 1.25 or less. Such relatively low indices of refraction help reduce the image distortion of indicia 10 because the speed of light is reduced to a lesser extent.

The transparent or translucent cover 14 of the present invention may additionally act as a lens, magnifying the appearance of the core or intermediate layer below. Any indicia 10 on the core or intermediate layer will then also be magnified. More particularly, the transparent or translucent cover 14 comprises a polymeric material having a magnification factor from about 2× to about 5× to make text or other markings, such as indicia 10, printed on the surface of the layer immediately beneath the cover 14 appear larger than its actual size. The actual size of any text or markings is typically small given the limited amount of space on the surface of the golf ball layer. Because a player may not be able to easily discern the fine text or marking, it is advantageous to magnify the physical appearance of the indicia 10. The magnified appearance of the core or intermediate layer or any marking on the surface of the core or intermediate layer may also enhance a player's ability to visualize the ball, and hence may improve a player's ability to strike the ball in the desired location.

Figure 4:
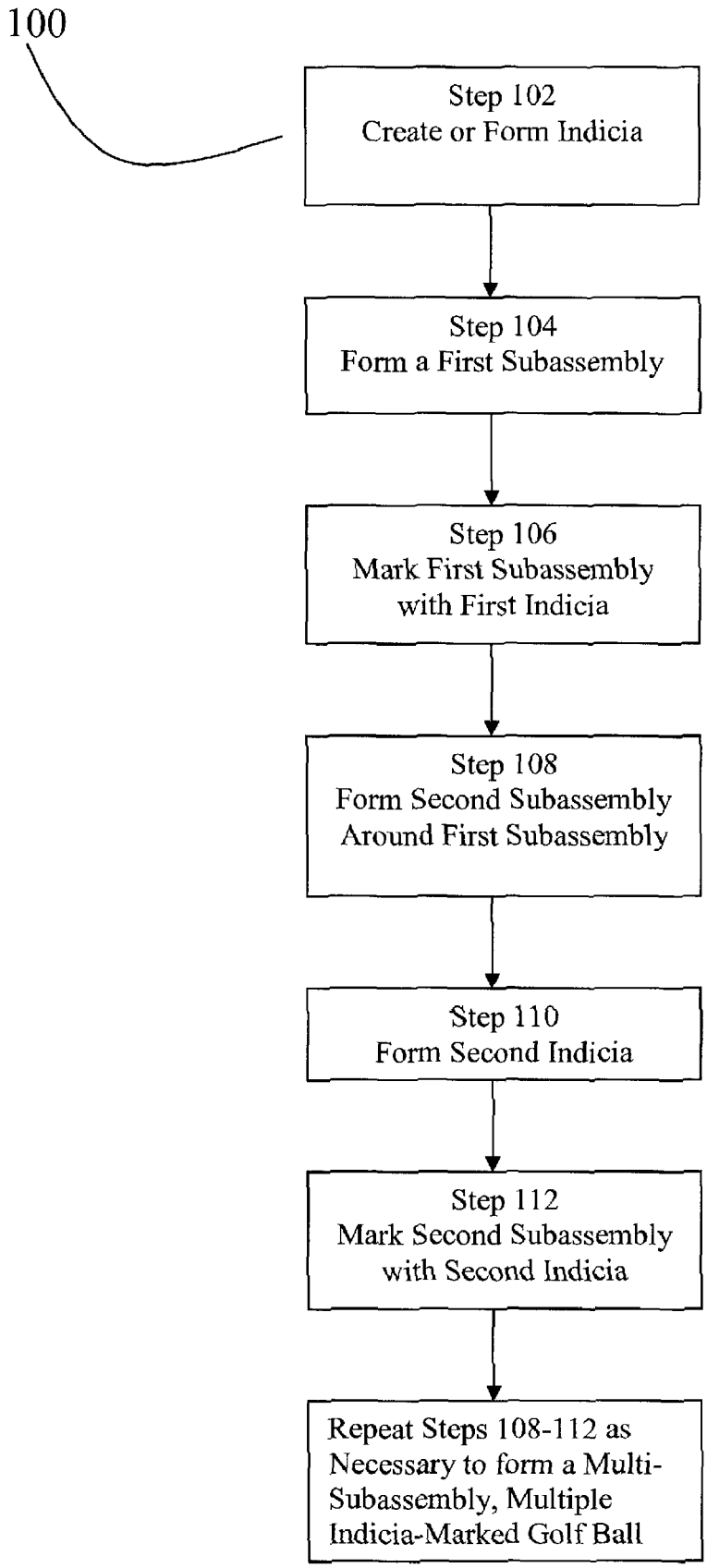
FIG. 4 is a is a flowchart illustrating a method for noncontact printing of indicia on a golf ball.

FIG. 4 shows a method 100 for noncontact printing of indicia 10 on one or more golf ball layers. The first steps 102 and 104 of the process are somewhat flexible in order, and can be performed before, after, or simultaneously with respect to each other to optimize for increased production yield and efficiency. The indicia 10 can be created or drawn in any manner known to a person of ordinary skill in the art (step 102). For example, the indicia 10 can be created with a computer using a software program such as Adobe Photoshop®, Adobe Illustrator®, or the like. The indicia 10 can also be a hand drawn image or logo scanned into digital memory.

Indicia 10 can serve many useful functions. For instance, indicia 10 can be stripes that identify practice or range balls, and help distinguish among the golf balls of various players. As discussed below, subsurface indicia 10 can be used to track a particular golf ball through production or through the lifetime of a ball. Furthermore, subsurface indicia 10 could be helpful to deter golf ball refurbishers from using a manufacturer's recovered golf ball and to claim as their own after removing the original logos on the outermost surface. The flexibility of noncontact printing, versus conventional contact printing, also allows the customization of indicia 10 in response to customer requests.

Another possible initial step of the process can be to form a golf ball subassembly (step 104). The golf ball subassembly can be formed prior to the creation of indicia 10 or after creation of the indicia 10 in step 102. The golf ball subassembly can be any layer of the golf ball 12 including, but not limited to, translucent cover 14, core 16, and intermediate layer 18 that can preferably include a pigment such that it can add to the overall appearance of the ball 12.

In step 106, a noncontact printing system is used to create indicia 10 on a golf ball subassembly. Noncontact printing systems can provide flexibility in image printing and typically include ink jet printing, wax jet printing, bubble jet printing, laser jet printing, and the like. Changing from one image to the next may be done rapidly without stopping the process, thereby facilitating customization of indicia 10. Drop-on-demand ink jet printing apparatuses have been used to apply inks to a variety of substrates. A drop-on-demand ink jet printing apparatus is an apparatus that selectively discharges small individual droplets of ink onto a substrate in a predetermined pattern to form an image. In this type of apparatus, the print head does not contact the substrate on which it prints.

A commercially available noncontact printing system is the rubber printing system available from Pannier Corporation of Pittsburgh, Pa. The Pannier rubber printing system is a noncontact ink jet marking system suitable for printing text and graphics, ranging form ⅜" to 5¼" in height, on uncured rubber. A maximum of 800 dots per second can be applied using the Pannier rubber printing system, which is compatible with a broad set of inks including, but not limited to, MEK, ethyl acetate, ethyl alcohol, isopropyl alcohol, water-based, and curable ink. Such ink jet printing systems are well suited to producing fine patterns with high detail. More particularly, the ink jet printing systems advantageously form indicia 10 that are not susceptible to ink degradation given that they are solid markings created by very small dots. Further, ink jet printing also allows rapid changes to the pattern with only a change in programming versus fabrication of new printing rolls, screens, or plates. Moreover, unlike conventional contact printing systems such as pad printing systems, the Pannier rubber printing system can dispense inks without regard to ink viscosity, advantageously allowing the dispensing of inks visible under non-ambient wavelengths that have a relatively high viscosity.

Indicia 10 may be marked with inks that are visible in ambient light (i.e., in the 380 to 750 nm spectrum). Alternatively, the ink used to mark indicia 10 can be visible only when exposed to certain non-ambient wavelengths, e.g. long ultraviolet wavelengths in the range of 400 nm to 315 nm. Such inks can be used when indicia 10 are created for purposes other than aesthetic decoration. For example, indicia 10 can be used to track a particular golf ball subassembly through production or through the lifetime of the ball by marking real-time date and time codes, and as a result it may be desirable to only use ink that is visible under non-ambient light, thereby hiding marks that may make the golf ball aesthetically unpleasing. Until now, it has been difficult to apply such inks, visible under non-ambient light, to a golf ball subassembly because they are relatively more viscous than other inks, and conventional contact printing methods such as pad printing are not capable of dispensing such viscous inks.

Once the indicia marking of the first golf ball subassembly (e.g., a core) is complete in step 106, a second golf ball subassembly (e.g. an intermediate layer or cover) can be formed around the first golf ball subassembly in optional step 108. If desired, this second golf ball subassembly can also be marked with an indicia in optional step 112, wherein any suitable printing system, including but not limited to, a contact printing system or noncontact printing system can be used to mark the indicia. The indicia can be the same as, or distinctly different from, the indicia used to mark the first golf ball subassembly in step 110. If the indicia is different, then it can be created or digitally obtained in optional step 110. For maximum efficiency, step 110 can be performed at the same time as step 102. Subsequent golf ball subassemblies can then be further applied to the existing subassemblies by repeating steps 108-112 as necessary, each layer having either similar or distinctly different indicia from the core or each other.

Preferably, the cover 14 is comprised of clear, unpigmented urethane or urea that can be cast, injection molded, compression molded or reaction injection molded over a colored golf ball precursor. For example, the cover 14 is clear and the adjacent intermediate layer 18 is colored. Any color(s) may be used to create golf balls according to the present invention. In Japan, and to a lesser extent in the United States, various pastel shades of blue, green and others have appeared on the cover of two-piece balls. These colors could be obtained from using the pigment in an inner intermediate layer 18 while the outer cover 14 includes either a fluorescent dye or optically active chemical additive to further enhance the color.

A preferred embodiment includes a clear outer cover layer 14, one as close to optically transparent as possible, but in other embodiments a translucent outer cover layer 14 may be preferred. The use of a lightly colored or tinted outer cover layer 14 makes possible color depth characteristics not previously possible. Similarly, the intermediate layer 18 can contain reflective or optically active particulates such as described by Murphy in U.S. Pat. No. 5,427,378 which is incorporated by reference herein. In particular, these materials could be used in the intermediate layer 18 of the present invention and covered with a clear outer cover layer 14. Pearlescent pigments sold by the Mearle Corporaton can also be used in this way or can be added to the substantially clear outer layer 14.

If employed, it is preferable that the reflective material comprises at least one member selected from the group consisting of metal flake, iridescent glitter, metallized film and colored polyester foil. The reflective particles preferably have faces that have an individual reflectance of over 75%, more preferably at least 95%, and most preferably 99-100%. For example, flat particles with two opposite faces can be used.

Dye or pigment may be added to the cover material to create a golf ball having a translucent colored cover. The dye may be a fluorescent dye. In general, fluorescent dyes useful in the present invention include dyes from the thioxanthene, xanthene, perylene, perylene imide, coumarin, thioindigoid, naphthalimide and methine dye classes. Useful dye classes have been more completely described in U.S. Pat. No. 5,674,622, which is incorporated herein by reference in its entirety. Representative yellow fluorescent dye examples include, but are not limited to: Lumogen F Orange™ 240 (BASF, Rensselaer, N.Y.); Lumogen F Yellow™ 083 (BASF, Rensselaer, N.Y.); Hostasol Yellow™ 3G (Hoechst-Celanese, Somerville, N.J.); Oraset Yellow™ 8GF (Ciba-Geigy, Hawthorne, N.Y.); Fluorol 088™ (BASF, Rensselaer, N.Y.); Thermoplast F Yellow™ 084 (BASF, Rensselaer, N.Y.); Golden Yellow™ D-304 (DayGlo, Cleveland, Ohio); Mohawk Yellow™ D-299 (DayGlo, Cleveland, Ohio); Potomac Yellow™ D-838 (DayGlo, Cleveland, Ohio) and Polyfast Brilliant Red™ SB (Keystone, Chicago, Ill.).

Preferably, the transparent or translucent cover 14 of the present invention is made from thermoplastic and thermoset materials, preferably polyurethane, polyurea, and ionomer resins.

Polyurethane that is useful in the present invention includes the reaction product of polyisocyanate, at least one polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), m-phenylene diisocyanate ("MPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; isocyanurate of HDI; triisocyanate of 2,4,4-trimethyl-1,6-hexane diisocyanate ("TMDI"), tetracene diisocyanate, napthalene diisocyanate, anthracene diisocyanate, and mixtures thereof. Polyisocyanates are known to those of ordinary skill in the art as having more than one isocyanate group, e.g., di-, tri-, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" isocyanate monomer, typically less than about 0.1 percent to about 0.5 percent free monomer. Examples of "low free monomer" diisocyanates include, but are not limited to Low Free Monomer MDI, Low Free Monomer TDI, Low Free MPDI, and Low Free Monomer PPDI.

The at least one polyisocyanate should have less than about 14 percent unreacted NCO groups. Preferably, the at least one polyisocyanate has less than about 7.9 percent NCO, more preferably, between about 2.5 percent and about 7.8 percent, and most preferably, between about 4 percent to about 6.5 percent.

Any polyol available to one of ordinary skill in the art is suitable for use according to the invention. Exemplary polyols include, but are not limited to, polyether polyols, hydroxy-terminated polybutadiene and partially/fully hydrogenated derivatives, polyester polyols, polycaprolactone polyols, and polycarbonate polyols. In one preferred embodiment, the polyol includes polyether polyol, more preferably those polyols that have the generic structure:

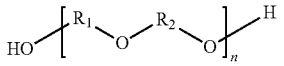

where $R_1$ and $R_2$ are straight or branched hydrocarbon chains, each containing from 1 to about 20 carbon atoms, and n ranges from 1 to about 45. Examples include, but are not limited to, polytetramethylene ether glycol, polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Preferred polyester polyols have the generic structure:

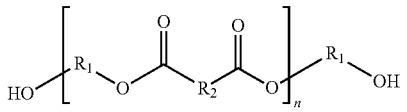

where $R_1$ and $R_2$ are straight or branched hydrocarbon chains, each containing from 1 to about 20 carbon atoms, and n ranges from 1 to about 25. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups. In another embodiment, polycaprolactone polyols are included in the materials of the invention.

Preferably, any polycaprolactone polyols have the generic structure:

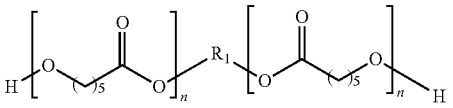

where $R_1$ is a straight chain or branched hydrocarbon chain containing from 1 to about 20 carbon atoms, and n is the chain length and ranges from 1 to about 20. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Preferably, any polycarbonate polyols have the generic structure:

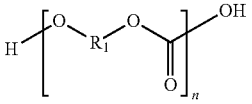

where $R_1$ is predominantly bisphenol A units -(p-$C_6H_4$)—C($CH_3$)$_2$-(p-$C_6H_4$)— or derivatives thereof, and n is the chain length and ranges from 1 to about 20. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000. Polyamine curatives are also suitable for use in the polyurethane composition of the invention and have been found to improve cut, shear, and impact resistance of the resultant balls. Preferred polyamine curatives have the general formula:

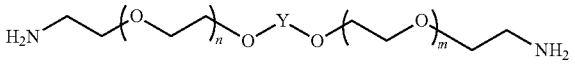

where n and m each separately have values of 0, 1, 2, or 3, and where Y is ortho-cyclohexyl, meta-cyclohexyl, para-cyclohexyl, ortho-phenylene, meta-phenylene, or para-phenylene, or a combination thereof. Preferred polyamine curatives include, but are not limited to, 3,5-dimethylthio-2,4-toluenediamine and isomers thereof (trade name ETHACURE 100 and/or ETHACURE 100 LC); 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyl-diamino diphenyl methane; para, para'-methylene dianiline (MDA), m-phenylenediamine (MPDA), 4,4'-methylene-bis-(2-chloroaniline) (MOCA), 4,4'-methylene-bis-(2,6-diethylaniline), 4,4'-diamino-3,3'-diethyl-5,5'-dimethyl diphenylmethane, 2,2',3,3'-tetrachloro diamino diphenylmethane, 4,4'-methylene-bis-(3-chloro-2,6-diethylaniline), (LONZACURE M-CDEA), trimethylene glycol di-p-aminobenzoate (VERSALINK 740M), and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000. Preferably, n and m, each separately, have values of 1, 2, or 3, and preferably, 1 or 2.

At least one of a diol, triol, tetraol, hydroxy-terminated, may be added to the aforementioned polyurethane composition. Suitable hydroxy-terminated curatives have the following general chemical structure:

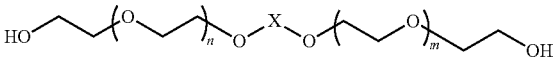

where n and m each separately have values of 0, 1, 2, or 3, and where X is ortho-phenylene, meta-phenylene, para-phenylene, ortho-cyclohexyl, meta-cyclohexyl, or para-cyclohexyl, or mixtures thereof. Preferably, n and m, each separately, have values of 1, 2, or 3, and more preferably, 1 or 2.

Preferred hydroxy-terminated curatives for use in the present invention include at least one of 1,3-bis(2-hydroxyethoxy)benzene and 1,3-bis-[2-(2-hydroxyethoxy)ethoxy]benzene, and 1,3-bis-{2-[2-(2-hydroxyethoxy)ethoxy]ethoxy}benzene; 1,4-butanediol; resorcinol-di-(β-hydroxyethyl)ether; and hydroquinone-di-(β-hydroxyethyl)ether; and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art. Both the hydroxy-terminated and amine curatives can include one or more saturated, unsaturated, aromatic, and cyclic groups. Additionally, the hydroxy-terminated and amine curatives can include one or more halogen groups. Suitable diol, triol, and tetraol groups include ethylene glycol, diethylene glycol, polyethylene glycol, propylene glycol, polypropylene glycol, lower molecular weight polytetramethylene ether glycol, and mixtures thereof. The polyurethane composition can be formed with a blend or mixture of curing agents. If desired, however, the polyurethane composition may be formed with a single curing agent.

The cover 14 may alternatively comprise polyurea. In one embodiment, the polyurea prepolymer includes at least one diisocyanate and at least one polyether amine.

In this aspect of the invention the diisocyanate is preferably saturated, and can be selected from the group consisting of ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl)dicyclohexane; 2,4'-bis(isocyanatomethyl)dicyclohexane;

isophoronediisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; and mixtures thereof. The saturated diisocyanate is preferably selected from the group consisting of isophoronediisocyanate, 4,4'-dicyclohexylmethane diisocyanate, 1,6-hexamethylene diisocyanate, or a combination thereof. In another embodiment, the diisocyanate is an aromatic aliphatic isocyanate selected from the group consisting of meta-tetramethylxylene diisocyanate; para-tetramethylxylene diisocyanate; trimerized isocyanurate of polyisocyanate; dimerized uredione of polyisocyanate; modified polyisocyanate; and mixtures thereof.

The polyether amine may be selected from the group consisting of polytetramethylene ether diamines, polyoxypropylene diamines, poly(ethylene oxide capped oxypropylene) ether diamines, triethyleneglycoldiamines, propylene oxide-based triamines, trimethylolpropane-based triamines, glycerin-based triamines, and mixtures thereof. In one embodiment, the polyether amine has a molecular weight of about 1000 to about 3000.

The curing agent may be selected from the group consisting of hydroxy-terminated curing agents, amine-terminated curing agents, and mixtures thereof, and preferably has a molecular weight from about 250 to about 4000.

In one embodiment, the hydroxy-terminated curing agents are selected from the group consisting of ethylene glycol; diethylene glycol; polyethylene glycol; propylene glycol; 2-methyl-1,3-propanediol; 2-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl)ether; 1,5-pentanediol; 1,6-hexanediol; 1,3-bis-(2-hydroxyethoxy)cyclohexane; 1,4-cyclohexyldimethylol; 1,3-bis-[2-(2-hydroxyethoxy)ethoxy]cyclohexane; 1,3-bis-{2-[2-(2-hydroxyethoxy)ethoxy]ethoxy}cyclohexane; trimethylolpropane; polytetramethylene ether glycol, preferably having a molecular weight from about 250 to about 3900; and mixtures thereof.

The amine-terminated curing agents may be selected from the group consisting of ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; and mixtures thereof.

In one embodiment, the composition further includes a catalyst that can be selected from the group consisting of a bismuth catalyst, zinc octoate, di-butyltin dilaurate, di-butyltin diacetate, tin (II) chloride, tin (IV) chloride, di-butyltin dimethoxide, dimethyl-bis[1-oxonedecyl)oxy]stannane, di-n-octyltin bis-isooctyl mercaptoacetate, triethylenediamine, triethylamine, tributylamine, oleic acid, acetic acid; delayed catalysts, and mixtures thereof. The catalyst may be present from about 0.005 percent to about 1 percent by weight of the composition.

Any method available to one of ordinary skill in the art may be used to combine the polyisocyanate, polyol or polyamine, and curing agent of the present invention. One commonly employed method, known in the art as a one-shot method, involves concurrent mixing of the polyisocyanate, polyol or polyether amine, and curing agent. This method results in a mixture that is inhomogenous (more random) and affords the manufacturer less control over the molecular structure of the resultant composition. A preferred method of mixing is known as the prepolymer method. In this method, the polyisocyanate and the polyol or polyether amine are mixed separately prior to addition of the curing agent. This method seems to afford a more homogeneous mixture resulting in a more consistent polymer composition.

As mentioned above, the cover layer 14 may also comprise ionomeric materials, such as ionic copolymers of ethylene and an unsaturated monocarboxylic acid, which are available under the trademark SURLYN® of E.I. DuPont de Nemours & Co., of Wilmington, Del., or IOTEK® or ESCOR® of ExxonMobil. These are copolymers or terpolymers of ethylene and methacrylic acid or acrylic acid totally or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The cover layer may also include at least one ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. The ionomer may include so-called "low acid" and "high acid" ionomers, as well as blends thereof. In general, ionic copolymers including up to about 15 percent acid are considered "low acid" ionomers, while those including greater than about 15 percent acid are considered "high acid" ionomers.

"Low acid" ionomers may be combined with a softening comonomer such as vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, and butyl methacrylate, and are believed to impart high spin to golf balls.

Covers comprising "high acid" ionomers are believed to impart low spin and longer distance to golf balls. A cover of the present invention may comprise about 15 to about 35 weight percent acrylic or methacrylic acid, making the ionomer a high modulus ionomer. An additional comonomer such as an acrylate ester (i.e., iso- or n-butylacrylate, etc.) can also be included to produce a softer terpolymer. The additional comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

As used herein, the term "core" is used to refer to any portion of a golf ball surrounded by the cover. In the case of a golf ball having three or more layers, the term "core" includes at least one inner layer and typically refers to a center surrounded by at least one outer core layer or intermediate layer. Golf balls having at least two layers in the core are known as "dual core" golf balls. The center may be solid, gel-filled, hollow, or fluid-filled, e.g., gas or liquid. The term "inner core" is used interchangeably with "center" or "golf ball center," while the term "outer core" is used interchangeably with "intermediate layer" or "at least one intermediate layer." For example, one optional type of intermediate layer is a tensioned elastomeric material wound about the center. An intermediate layer may be included within a ball having, for example, a single layer or multilayer cover, a single layer or multilayer core, both a single layer cover and core, or both a multilayer cover and a multilayer core, or any similar such combination.

The cores of the golf balls formed according to the invention may be solid, semi-solid, hollow, fluid-filled or powder-filled, one-piece or multi-component cores. The term "semi-solid" as used herein refers to a paste, a gel, or the like. Any core material known to one of ordinary skill in that art is suitable for use in the golf balls of the invention. Suitable core materials include thermoset materials, such as rubber, styrene butadiene, polybutadiene, isoprene, polyisoprene, trans-isoprene, as well as thermoplastics such as ionomer resins, polyamides or polyesters, and thermoplastic and thermoset polyurethane elastomers. As mentioned above, the polyurethane and polyurea compositions of the present invention may also be incorporated into any component of a golf ball, including the core.

In one embodiment, the golf ball core is formed from a composition including a base rubber (natural, synthetic, or a combination thereof), a crosslinking agent, and a filler. In another embodiment, the golf ball core is formed from a reaction product that includes a cis-to-trans catalyst, a resilient polymer component having polybutadiene, a free radical source, and optionally, a crosslinking agent, a filler, or both. Various combinations of polymers, cis-to-trans catalysts, fillers, crosslinkers, and a source of free radicals, such as those disclosed in commonly owned U.S. Pat. No. 6,998,445, entitled "Low Compression, Resilient Golf Balls With Rubber Core," filed Jul. 9, 2002 and issued Feb. 14, 2006, the entire disclosure of which is incorporated by reference herein, may be used to form the reaction product. Although this polybutadiene reaction product is discussed in a section pertaining to core compositions, the present invention also contemplates the use of the reaction product to form at least a portion of any component of a golf ball.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

The invention claimed:

1. A method of forming indicia on a golf ball comprising the steps of:

(a) providing a first golf ball subassembly having a first outer surface, the first subassembly being selected from the group consisting of a core layer, an intermediate layer, and a combination thereof;

(b) utilizing a noncontact printing system to mark the first outer surface with ink that forms a first indicia;

(c) foaming, around the first golf ball subassembly, a second golf ball subassembly with a second outer surface, the second subassembly comprising a cover layer, wherein the second golf ball subassembly is partially transparent or translucent; and (d) optionally utilizing a printing system to mark the second outer surface with an ink that forms a second indicia, and wherein at least one of the intermediate or cover layers comprises reflective or optically active particulates having faces with an individual reflectance of at least about 75%.

2. The method of claim 1, wherein steps (c) and (d) are repeated until a desired number of golf ball subassemblies is formed.

3. The method of claim 1, wherein the reflective material comprises at least one member selected from the group consisting of metal flake, iridescent glitter, metallized film and colored polyester foil.

4. The method of claim 1, wherein the golf ball subassembly comprises a core and intermediate layer and the intermediate layer is partially translucent or transparent.

5. The method of claim 4, wherein the core layer has a third indicia.

6. The method of claim 1, wherein the first indicia is created in computer memory before step (b) and wherein the second indicia is optionally created in computer memory before step (d).

7. The method of claim 1, wherein the second subassembly has an average transmittance of visible light of at least about 10%.

8. The method of claim 1, wherein the second subassembly has an index of refraction of about 3.0 or less.

9. The method of claim 1, wherein the second subassembly has a magnification factor of at least about 2 to about 5.

* * * * *